US005398878A

United States Patent [19]

Möhrke

[11] Patent Number: 5,398,878

[45] Date of Patent: Mar. 21, 1995

[54] METHOD AND APPARATUS FOR PRODUCING A PREDETERMINED NUMBER OF FULL YARN PACKAGES ON AN AUTOMATIC WINDER

[75] Inventor: Dieter Möhrke, Mönchengladback, Germany

[73] Assignee: W. Schlafhorst AG & Co., Moenchengladbach, Germany

[21] Appl. No.: 62,073

[22] Filed: May 14, 1993

[30] Foreign Application Priority Data

May 15, 1992 [DE] Germany ..... 42 16 097.9

[51] Int. Cl.[6] ..... B65H 67/06

[52] U.S. Cl. ..... 242/35.5 A; 242/36

[58] Field of Search ..... 242/35.5 R, 35.5 A, 242/36

[56] References Cited

U.S. PATENT DOCUMENTS

| | | | |
|---|---|---|---|
| 4,078,737 | 3/1978 | Rehr | 242/39 |
| 4,595,152 | 6/1986 | Matsui et al. | 242/35.5 A |
| 4,660,370 | 4/1987 | Matsui et al. | 242/35.5 A X |
| 4,809,919 | 3/1989 | Ueda et al. | 242/35.5 R |
| 4,856,723 | 8/1989 | Tone | 242/36 X |
| 4,913,373 | 4/1990 | Ueda | 242/36 X |

FOREIGN PATENT DOCUMENTS

| | | |
|---|---|---|
| 3733788A1 | 4/1988 | Germany . |
| 3808465A1 | 9/1988 | Germany . |
| 603474 | 8/1978 | Switzerland . |

*Primary Examiner*—Daniel P. Stodola
*Assistant Examiner*—Michael R. Mansen
*Attorney, Agent, or Firm*—Shefte, Pinckney & Sawyer

[57] ABSTRACT

A method and apparatus for simplified control of an automatic yarn winder to enable production of as many full yarn packages as possible. A predetermined total number of full packages to be produced is divided by the number of winding stations of the automatic winder. In the event that the quotient is not an integer, it is rounded off up and down for each winding station to an integer within an upper and a lower limit value with the sum of all the rounded-off values being equal to the predetermined number. The winding stations are taken out of operation individually as each station's rounded-off value is reached. The automatic winder has a detector for detecting the number of finished packages per winding station and memory locations for storing the detected number. An input device for inputting the predetermined values for the respective predetermined number of packages of the various winding stations is coupled with a circuit for deactuating winding stations once the value is reached. The automatic winder advantageously has a closed transport system for carriers on which yarn supply cops or tubes are mounted.

11 Claims, 1 Drawing Sheet

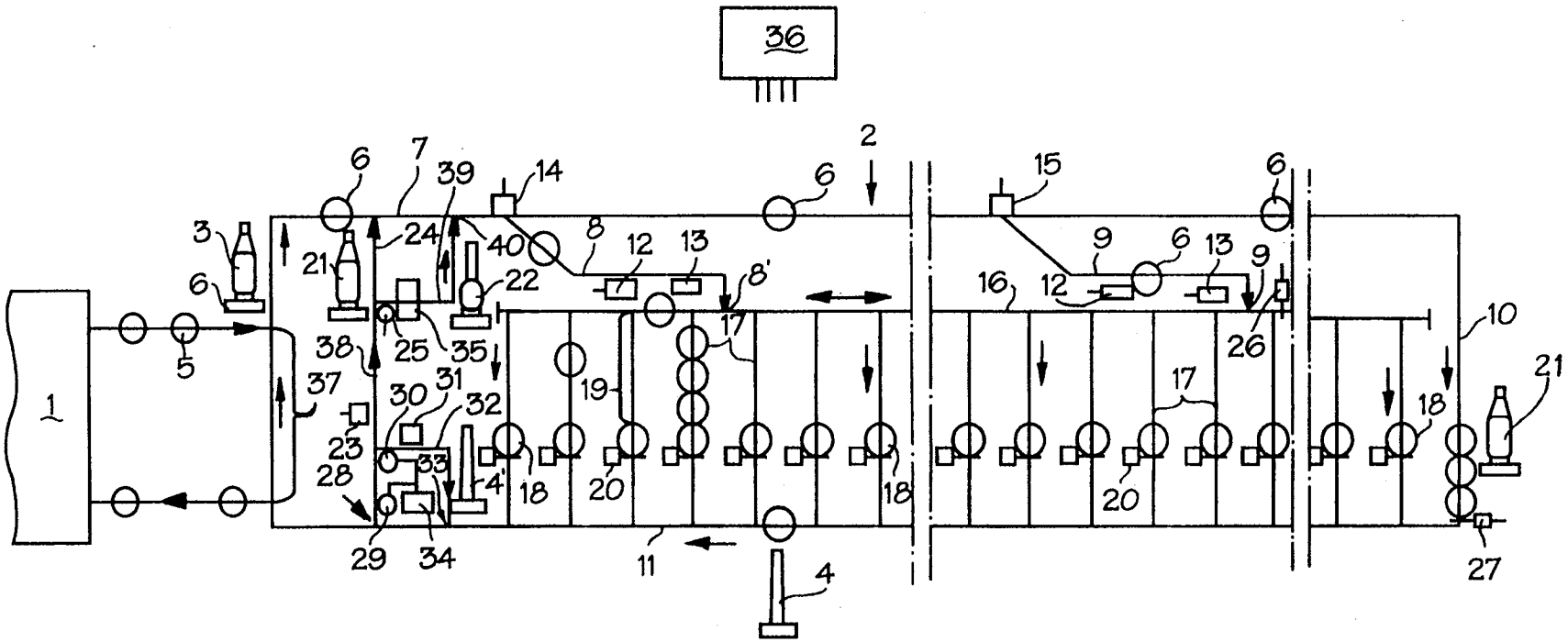
1
2
3
4
5
6
7
8
8'
9
10
11
12
13
14
15
16
17
18
19
20
21
22
23
24
25
26
27
28
29
30
31
32
33
34
35
36
37
38
39
40

METHOD AND APPARATUS FOR PRODUCING A PREDETERMINED NUMBER OF FULL YARN PACKAGES ON AN AUTOMATIC WINDER

BACKGROUND OF THE INVENTION

The invention relates generally to textile yarn winding methods and automatic textile yarn winders and, more particularly, to a novel method and apparatus for producing a predetermined number of full yarn packages on an automatic winder.

Automatic textile yarn winders are generally used to rewind or wind yarn, furnished in the form of cops from a ring spinning machine or another spinning station, to make conical or cylindrical cross-wound yarn packages commonly referred to as bobbins and also known as cheeses or cheese packages. As a rule, the size of a given lot or run of a textile yarn winder, i.e., the total number of yarn packages to be produced during a single operation, is fixed in advance. A lot or run may also include different batches of yarn packages, i.e., differing packages formed from yarn supplies having different yarn characteristics. In principle, there are two possible ways to end production of a particular lot. One is to interrupt the winding process after all the supply cops of one batch have been wound. For many years, however, it has been recognized that this procedure has the disadvantage of producing a large number of incompletely wound yarn packages. As early as the 1970s, this disadvantage was overcome by successively shutting down the winding stations individually after full packages were produced at the end of the lot or batch.

For determining the specific time at which successive shutdown of winding stations could be started, the number of winding stations used to produce the yarn packages was subtracted from the total number of yarn packages to be produced. Once that subtracted value was reached, the winding stations were then shut down successively. This known method is disclosed in German Patent DE 37 33 788.

By that method, it was necessary each time the yarn package was changed to determine the total of all the cheese packages produced on all the winding stations and compare it with a target variable. The order in which the winding stations were taken out of operation was distributed completely randomly over the entire winding machine.

SUMMARY OF THE INVENTION

The object of the present invention is to provide a simplified winding method which makes possible a more orderly shutdown of the winding stations and to provide an automatic winder for performing this method.

According to the method and apparatus of the present invention, this object is achieved in the operation of an automatic textile yarn winder which comprises a plurality of winding stations each having a respective yarn supply by the basic steps of initially determining for each individual winding station a respective predetermined number of full yarn packages to be wound at the individual winding station and then individually deactuating each winding station and its respective yarn supply after the respective predetermined number of full yarn packages is wound at the individual winding station. Under the present invention, the respective predetermined numbers of full yarn packages for the plural winding stations are determined by dividing a predetermined total number of full yarn packages to be produced by the number of winding stations of the automatic winder. In the event that the quotient of this computation is not an integer, the quotient is rounded upwardly or downwardly respectively for each individual winding station to a respective integer within an upper and a lower limit value. The sum of all the rounded-off integers is equal to the predetermined total number of yarn packages.

Because the number of yarn packages to be produced by each winding station is predetermined in fixed fashion, it is not necessary with the present invention to perform constant calculation over the entire winding operation. The winding stations are each shut down individually once the applicable predetermined command number of yarn packages has been produced. Since the division of the total number of packages to be produced by the number of winding stations can produce a value that is not an integer, yet the winding stations are intended to produce only full packages, it becomes necessary in that case to round off the quotient up and down. Of course, this aspect of the present invention does not preclude the possibility of defining different predetermined command numbers for the various winding stations even if the computed quotient is an integer, which makes it possible to purposefully influence the order in which the winding stations are taken out of operation.

In an automatic winder, the number of yarn packages to be produced is not always a known preset number. On the contrary, a given winding lot or run may involve the rewinding of a certain number of yarn cops in order to produce a maximum number of full yarn packages from the cops. In that case, it is necessary before the quotient is computed to calculate the number of yarn packages that can be expected to be produced by the quantity of yarn available on the supply cops.

Even if it can normally be assumed that with a simultaneous start of all the winding stations for one lot or batch only slight differences in the quantity of yarn wound or rewound will arise over the course of a winding operation, it is still possible, if one winding station is down for a relatively long time as a result of some defect, that any given winding station could encounter a backlog or delay that amounts to one full yarn package compared with the other winding stations. For this exceptional case, it is advantageous if the predetermined command number or value for this winding station is reduced by one and in return the predetermined number for another winding station is increased by one, so that in the final analysis the specified predetermined total number of yarn packages remains the same. To achieve this result, it is possible to provide one or more winding stations whose predetermined command number is reduced by one from the very outset. These winding stations are then intended directly to have their command value increased by one as needed during processing of the entire lot, but even if no provision is made to carry out this intended increase, no problem is created because, in contrast to a winding station with a backlog, these winding stations do not cause any delay at the end of the winding of the lot or batch.

It is equally possible to determine one winding station, whose predetermined command number is set to be equivalent to the lower limit value, to enable this station to take on the production of one additional yarn package.

A groupwise graduation in the number of yarn packages to be produced is especially advantageous with a view to the conversion to a new batch. With the calculation method of the present invention, this objective can be achieved especially simply. A further factor is that in automatic winders the delivery of cops to the winding stations can then also be shut down in groups. In this case, it is unnecessary to have means present at each winding station that prevent the delivery of cops after the shutdown. This groupwise shutdown mode can be achieved particularly advantageously if the graduation is made beginning at one end of the automatic winder.

The release of the remaining cops still in the upwinding position and of the further cops that are in the waiting position are then also graduated in groups. Since at that moment no new cops are supposed to be delivered to the winding station any more, there is no danger either than cops could drop freely through the shutdown winding stations.

The present invention also contemplates the provision of apparatus in an automatic textile yarn winder suitable to enable the winder to perform the method of the present invention. More particularly, the present apparatus comprises a suitable means for individually deactuating each winding station and its respective yarn supply after the station's respective predetermined number of full yarn packages is wound. According to the invention, the deactuating means comprises means for detecting the number of finished yarn packages at each winding station, memory locations for storing the detected number of yarn packages, an input device for inputting command values representing the respective predetermined number of yarn packages of the various winding stations, and a circuit for deactuating the winding stations once the command value is reached.

The memory locations for storing the detected number of finished packages may be present either in the winding station computers assigned to each winding station or at a central location of the automatic winder. If the memory locations are provided in the winding station computers, it is nevertheless advantageous to provide a central input device for inputting the command values and to transfer these command values to the winding stations over a data bus. However, it is also possible to have decentralized input at the various winding stations. Typically, the finishing of the package is detected and counted by the winding station computer. Accordingly, the shutdown of the winding station can be accomplished without difficulty once the command value is reached. The control of the winding station may be programmed such that the removal of the last yarn package will still perform a bobbin change, i.e., position a new winding tube in place. However, after the change, the winding station is not put back into operation.

Since the winder is typically equipped with suitable means to detect when the winding station is in operation, it is also possible to ascertain the down time of each station. To that end, one memory channel may be assigned to each winding station. Central detection of the data specific to each winding station also enables a comparison of the number of already-produced packages or of shutdown times over the entire winding machine. By means of a monitoring device, it is therefore readily possible to ascertain when the time interval between the winding station having the lowest total down time and the winding station with the highest total down time becomes so great that it is equivalent to the time required to produce one full package. In that case, the monitoring device can raise the predetermined command number at a predetermined winding station.

If an automatic winder has a closed transport system for yarn tube carriers such as caddies that has a distribution path extending along the winding stations, then the length of this path can be shortened by means of transport gates. One or more groups of winding stations located side by side in the automatic winder can thus be separated from the process of cop delivery. This separation is accomplished whenever the applicable group of winding stations has been taken completely out of operation. Moreover, supplying the distribution path from a main delivery path via branch paths makes it possible with the aid of shunts to control the delivery of carriers to the distribution path to be matched to the number of winding stations still in operation. A detour path is provided to assure that cops not delivered to the branch paths can later be redistributed to the remaining branch paths.

The invention will be described in further detail below in terms of an exemplary embodiment of an automatic cheese winder.

BRIEF DESCRIPTION OF THE DRAWING

The accompanying drawing shows a schematic view of a transport loop for yarn tube carriers in an automatic winder according to the invention.

DESCRIPTION OF THE PREFERRED EMBODIMENT

As can be seen from the schematic view in the drawing, yarn-wound cops 3 are delivered on carriers 5 from the transport system of a ring spinning machine.1, only one end of which is shown, to an exchange path 37. On this exchange path 37, which is shared by the carriers 5 of the ring spinning machine and carriers 6 of the winding machine transport system, the yarn-wound cops 3 and empty tubes 4 on the carriers of each transport system are exchanged for one another. At the downstream end of the exchange path 37, the carriers 5 of the ring spinning machine transport system having the empty tubes 4 arrive back at the ring spinning machine 1. The carriers 6 of the winding machine transport system, with the empty tubes 4, likewise reach the exchange path 37, whereat the empty tubes 4 are replaced with the fresh yarn-wound cops 3 from the ring spinning machine 1. Since this kind of exchange path, with all the necessary equipment for carrying out the exchange, has already been described in German Patent Application P 40 34 824.5, a detailed description herein is unnecessary.

After leaving the exchange path 37, the carriers 6 with cops 3 are transported onward to the main delivery path 7 of the automatic winder 2 and reach branch paths 8 and 9. Along these branch paths 8 and 9, the cop-mounted carriers are transported to entry points 8' and 9' of a distribution path 16. A controlled shunt 14 is disposed at the beginning of the branch path 8 to assure that the carriers 6 mounted with cops 3 will be distributed uniformly, in normal operation, to the two branch paths 8 and 9 present in this example.

Cop preparation units 12 and 13 are disposed along the branch paths 8 and 9, but need not be described in detail since it is known to prepare cops in a plurality of stages by means of successively disposed preparation units (see German Patent DE 39 19 526 A1, for example).

The distribution path 16 appended to the branch paths 8 and 9 has a conveyor belt driven alternatingly in opposite directions, as a result of which the carriers 6 mounted with the cops 3 are distributed to the various winding stations of the automatic winder 2 along reserve portions 19 of a plurality of transverse transport paths 17, which are thereby maintained continuously filled. This distribution principle is described in German Patent DE 38 43 554 A1, for example.

The transverse transport paths 17 extend from the distribution path 16 through the multiple winding stations 18 of the winder to a tube return path 11 that is common to and extends along all the winding stations. At this point, it should be noted that for the sake of clarity, only individual carriers 6 have been shown at most of the winding stations, but typically two or three carriers 6 mounted with cops 3 are in a waiting position along each reserve path 19.

Once the cops 3 have been unwound, the carriers 6 with their empty tubes 4 leave the respective winding position 18 and are returned to the exchange path 37 along the tube return path 11.

However, since it is possible that a cop may not be completely unwound at the winding station, any incompletely unwound cops or tubes that contain a remnant yarn quantity should not reach the exchange path 37 and thereby be transferred to the ring spinning machine 1. A so-called cop scanner 34 is therefore disposed at the upstream end of the tube return path 11 in advance of a branching point 28 and operates on a mechanical or photooptical basis to distinguish between empty tubes with a very small yarn remnant and so-called remnant cops 22 having a more significant amount of remnant yarn and even cops that are still fully wound, as may occur for instance if the winding station was unable to catch the beginning of the yarn.

The cop scanner 34 is connected to two schematically shown shunts 29 and 30, which control the carriers depending on the outcome of monitoring by the cop scanner 34. For instance, if the cop scanner detects an empty tube 4, then both shunts 29 and 30, which may for instance operate on an electromagnetic basis if the carriers are partly of ferromagnetic material, are not activated, so that the carrier 6 with the empty tube 4 can continue from the branching point 28 along the return path 11 directly to the exchange path 37. If a small yarn remnant is detected, then both shunts 29 and 30 are activated, causing the caddy 6 in question to be diverted so that it reaches a secondary transport path 32. A tube cleaner 31 is disposed along this second transport path 32 for removing relatively small yarn remnants. After leaving the tube cleaner 31, the cleaned tube 4' with its carrier 6 is transported to an entry point 33 at which it is returned to the tube return path 11. When the cleaned tube 4' moves past the cop scanner 34, the scanner detects an empty tube and does not actuate the shunts 29 and 30.

If the cop scanner 34 detects such a large remnant cop quantity that it is worthwhile to return the cop to the winding stations, then only the shunt 29 is activated, so that the applicable carrier 6 travels past the secondary transport path 32 on the secondary transport path 38 and is diverted by a shunt 25 to a branch path 39. A specific cop cone preparing device 35 is disposed along the branch path 39 and is operative to make a special attempt to find the beginning of the yarn on the cop cone. After leaving this cop cone preparing device 35, the carrier 6, with the prepared remnant cop 22, travels along the remainder of the branch path 39 and returns to the main delivery path 7 via the entry point 40.

The shunt 25 is normally set such that it deflects all the carriers 6 traveling along the secondary transport path 38 onto the branch path 39. However, if a sensor disposed downstream of the secondary transport path 38 detects a backup, then the shunt 25 is switched over so that the caddies can be delivered directly to the main delivery path 7 via the connecting path 24, which is necessary and desirable in order not to threaten the orderly branching of carriers at the shunts 29 and 30. Nevertheless, as will be explained hereinafter, this connecting path 24 has a special significance as well in connection with an end of a lot or batch.

Modern automatic yarn packages have display and input devices in their outer end that are connected to the various winding stations over a data bus. The winding stations themselves have individual respective winding station computers or microprocessors, in which data which is specific about the respective individual winding station are stored in memory and which also directly perform the control of the winding station. In these winding station computers, stop periods are recorded, stored in memory, and optionally may be called up and transmitted to a central control unit 36 usually provided at an outer end of the winder. In the same manner, the number of yarn packages produced at each winding station is automatically counted from a predetermined winder starting time.

Under the present invention, if a certain total number of yarn packages of a batch is to be specified to be produced by the entire winder, then first this number is divided by the number of winding stations in the automatic winder. This calculation operation will now be demonstrated with reference to several examples:

An automatic winder with 40 winding stations will be assumed. The target production for a given lot or run of the winder is a total of 980 full yarn packages. The quotient from the division of 980 packages by 40 winding stations is 24.5 packages per station. Since full yarn packages are desired, the quotient must be adjusted to a whole number or integer, but the total number of packages to be produced should remain unchanged. Thus, one alternative is to round the quotient up or down for each individual winding station to the next integer, e.g., 20 winding stations would be designated to each produce 24 packages and the other 20 winding stations would each be designated to produce 25 packages, resulting in the desired total of 980 packages.

In a second variant, a groupwise division of the winding stations into four groups of 10 successive winding stations each could be done. Dividing by 10 is typically equivalent to a sectional division of an automatic winder. In this case, the "last" section of ten winding stations, i.e., farthest away from the cop delivery location, would be designated to produce 23 yarn packages per station, while the other three sections in advance of such section would be designated respectively to produce 24, 25 and 26 packages per station in a staggered order of the sections relative to the direction of cop delivery. As a result, the sections will be taken out of operation in a given order.

The division by the second described variant would be considered more advantageous if the production time per yarn package is relatively low, which would be the case if relatively few packages are being wound from relatively coarse yarn. The time interval between when the first yarn packages are finished and the last yarn packages are finished would accordingly not be too long. By comparison, the first variant is preferred if relatively large yarn packages are being wound from fine yarn.

In a third possible variant, which is a derivative of the first described example, the predetermined number of yarn packages, or command value, per winding station at three of the winding stations which were designated in the first example to each produce 24 yarn packages is reduced by one, whereby these three stations are now designated to produce 23 packages each. To keep the total number of packages to be produced constant, the predetermined command number value is raised by one (i.e., to 25 packages each) in three other spinning stations which were designated to produce 24 packages per station. The result is a distribution of 23 winding stations that are to produce 25 yarn packages, 14 winding stations that are to produce 24 packages, and three winding stations that are to produce 23 cheese packages. This additional modification provides the ability for correction of the command value of a winding station that experiences considerable downtime, e.g., as a result of yarn breakages or other defect or failure. If the deficiency or backlog in number of full packages produced resulting from downtime in any given winding station reaches one full yarn package compared with the other winding stations during the course of a given lot or run, which can be ascertained by a monitoring device, then the predetermined command number value for the number of packages to be produced by that winding station is reduced automatically by one. At the same time, the predetermined command number value for one of the three winding stations having the reduced command value of 23 packages per station is raised by one, i.e., to 24 packages per station. If such a provision becomes unnecessary as a winding run progresses, e.g., because as is normally the case all the winding stations operate approximately identically, then no problem or disadvantage results from early shutdown of the aforementioned three winding stations when they complete their predetermined number of 23 packages each, since by far the predominant number of the 37 remaining winding stations is capable of continuing to operate. Naturally, the possibility also exists of providing only one winding station, instead of three, with a reduced predetermined command number value, whereby correspondingly only one winding station would have to be calculated with a command value raised by one in the event of a deficiency or backlog at another station.

In a similar variant based on a modification of the second above-described example, a reduction by one yarn package each may be made in two winding stations having the highest predetermined command number value, i.e., 26, which reduction would be offset by increasing by one the predetermined command number value of two winding stations designated to produce 24 packages each. The result is then the groupwise arrangement of 8 winding stations each designated to produce 26 packages, 14 winding stations each designated to produce 25 packages , 8 winding stations each designated to produce 24 packages and 10 winding stations each designated to produce 23 packages. Of course, in each variation, it should be assured that a suitable modification of the order of the predetermined package number values can be made as a correction so that the total number of packages to be produced is in fact reached.

Even without modifying the ordering of the predetermined package number values, if there is a backlog at one winding station at least equalling production time of one full yarn package, it is possible to designate certain winding stations in the program as escape winding stations, preferably winding stations that are designated with the lowest value for the predetermined command number value.

In a further example, it is assumed that 2285 kg of yarn, furnished in the form of cops by one or more spinning machines, is to be rewound, and the finished yarn packages in the completely wound state are intended to carry 3 kg of yarn. First, a certain range of waste, which can be expected to result for instance from yarn pieces removed by suction in the cop preparing devices or in the yarn stations during yarn splicing, or from the tube cleaner, must be taken into account and subtracted. If 5 kg of waste yarn is subtracted, then accordingly 2280 kg of usable yarn can be assumed. Dividing this value by 3 kg (i.e., the yarn weight of one package) results in a value of 760 total packages to be produced in this one winding lot or batch. Utilizing the forty station winder assumed in the previous examples, the division of the predetermined number of 760 total packages to be produced by 40 stations results in a quotient of the exact integer 19 packages per station, which may be adjusted for instance such that 20 packages are predetermined as the command number value at 10 winding stations, 19 packages per station are predetermined at 20 winding stations, and 18 packages per station are predetermined at the remaining ten winding stations. As will be understood, other similar modifications may be provided as in the variants already explained. The calculation of the appropriate variables can be done externally or in the central control unit of the automatic winder, if the latter is equipped with appropriate software.

Depending on the desired size of the yarn packages and on the fineness of the yarn to be rewound, the expected production time for one package can be ascertained, taking into account average downtimes such as result necessarily upon a cop change or in the event of yarn breakage, for instance. However, the possibility also exists of ascertaining this value only after the first yarn package has been finished, or by averaging the production time of some of the first several yarn packages. This value is stored in memory in the monitoring device, which is a component of the central control unit 36. As a result, the monitoring device can ascertain when a deficiency or backlog at any winding station equals or exceeds the production time for one full package. The monitoring device then starts a corrective procedure, in the form of reducing the predetermined command number value by one at this winding station and simultaneously increasing by one the predetermined command number value at another predesignated winding station. The selection of such a winding station will be apparent from the examples described above.

One transport gate 26 can be seen in the drawing along the distribution path 16. Although not shown here, such transport gates may be provided at all the predesignated section limits of the automatic winder 2. In the illustrated embodiment, the transport gate 26 is actuated whenever the rearmost section, in relation to the direction of cop delivery, has been entirely shut down. This is done, as already described with respect to the second above-described variant, by the appropriate staggering of the predetermined command number values for the number of packages to be produced.

As a result of the closure of this transport gate 26, no further cops enter this segment of the distribution path 16 and therefore no further cops are delivered to the deactuated endmost section of winding stations. The gates 20 that are disposed in the winding stations 18 of this end section are then opened, and as a result incompletely unwound cops 22 with remnant yarn still located in the winding stations and excess cops 21 that are in waiting positions along the reserve paths 19 are all discharged to the tube return path 11. To avoid blockages, the gates 20 are opened successively, under the control of the central control unit 36. Within this time period, a stop device 27, which is disposed upstream of the tube return path 11, is closed in order to temporarily hold back carriers 6 mounted with excess cops 21 that are being delivered to the return path 11 along the detour path 10.

As a result of the release of a number of excess cops 21 in the shut-down section of the automatic winder, a number of carriers arrive at the cop scanner 34 that must be diverted to the secondary transport path 38 causing this second transport path 38 to fill relatively quickly. However, this condition is detected by a sensor 23, which switches the shunt 35 so that the carriers with excess cops 21 can be delivered directly over the connecting path 24 and therefrom back to the main delivery path 7.

The shunt 15 disposed at the beginning of the branch path 9 has no function during normal operation except to divert all the arriving carriers to the branch path 9. However, after the last endmost winding station section serviced by the branch path 9 is shut down, the shunt 15 is positively controlled by the central control unit 36 to divert only as many carriers 6 to the branch path 9 as correspond to the number of winding stations still in operation. This means that, even following the stoppage of the rearmost section of winding stations, carriers continue to be directed from the main delivery path 7 onto the detour path 10. At the end of the detour path 10, these carriers 6 with excess cops 21 reach the tube return path 11, and from there are transported to the main delivery path 7 again, via the secondary transport path 28 and the connecting path 24, as described. The stop device 27 is normally opened and is closed only if, as described, one section of winding stations releases all the carriers located in it.

In order to shorten the overall downtime of the winder, it is considered advantageous to employ the method and apparatus of the invention to deliver new carriers and cops to winding station sections that have been shut down so that the shut-down stations may be readied for a new lot or batch while the other winding station sections of the automatic winder 2 are still in operation. This is relatively unproblematic in the case merely of a change of lot, where the same yarn cops are to be processed. However, if a different yarn batch is involved, i.e., the new cops are wound with a different yarn, then additional provisions are necessary to keep the different batches apart. Thus, it must be possible to separate the winding sections from one another. To that end, the cops, or the carriers carrying them, must carry codes or be encodeable and a sensor (not shown) must be disposed upstream of the shunt 14 that can distinguish these codes and actuate the shunt 14 as a function of the detected code.

The automatic winder 2 shown in the drawing has two separate branch paths 8 and 9, which readily make the separation into two batches possible. Once the two rearmost sections of winding stations, for instance, have been taken out of operation and converted to the new batch, the two forwardmost sections of winding stations could be supplied with cops 3 that are still in circulation or with excess cops 21 from the old batch, while along the exchange path 37 the carriers 6 onto which the cops of the new batch would be placed would have to be reencoded at the same time. Encodeable carriers are described in German Patent Application P 40 41 713.1, for example. This new code would be recognized by the sensor located upstream of the shunt 14. The shunt 14 would then be operated to cause these carriers to remain on the main delivery path 7 to travel to the branch path 9.

If the automatic winder is by way of example an open-end or an air spinning machine, then the cans or flyer bobbin holders are encoded instead.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for producing a predetermined total number of full yarn packages on an automatic textile yarn winder comprising a plurality of winding stations each having a respective yarn supply, said method comprising the steps of determining for each individual winding station a respective predetermined number of full yarn packages to be wound at the individual winding station and individually deactuating each winding station and the respective yarn supply after the respective predetermined number of full yarn packages is wound at the individual winding station, wherein the respective predetermined numbers of full yarn packages for the plural winding stations is determined by dividing the predetermined total number of full yarn packages by the number of winding stations of the automatic textile yarn winder and, in the event that the quotient is not an integer, rounding off the quotient up or down respectively for each individual winding station to a respective integer within an upper and a lower limit value, each individual winding station's respective rounded-off integer representing the respective predetermined number of full yarn packages to be wound thereat, the sum of all the rounded-off integers being equal to the predetermined total number of yarn packages.

2. The method of claim 1, wherein another winding station is assigned a predetermined number of yarn packages to be produced which is less than the lower limit value, and the number of yarn packages to be produced at the another winding station is increased by one in the event that a failure of one of said plurality of winding stations endures for a total length of time which is greater than the time required to produce a full yarn package.

3. The method of claim 1, wherein at least one of said plurality of winding stations is assigned the lower limit value and, in the event of a failure of a winding station of the automatic winder for a total length of time which is greater than the time for producing a yarn package, the predetermined number of a winding station assigned the lower limit value is increased by one.

4. The method of claim 1, wherein the winding stations are organized in groups and the winding stations of any group are assigned the same respective predetermined numbers which are increased or decreased relative to the other groups, while the total number of yarn packages to be produced is kept constant.

5. The method of claim 4, wherein, after one group of the winding stations has been deactuated, the yarn supply to the entire group is stopped.

6. The method of claim 1, wherein the predetermined number of yarn packages to be produced at each winding station increases from the lower limit value to a higher number from one end of the automatic winder toward the other end thereof.

7. In an automatic textile yarn winder having a plurality of winding stations each having a respective yarn supply, apparatus for producing a predetermined total number of full yarn packages on the automatic textile yarn winder comprising:

(a) means for storing respective predetermined numbers of full yarn packages for the plural winding stations, said storing means including first memory locations for said respective predetermined numbers of full yarn packages and an input device for inputing to said first memory locations command values representing the respective predetermined numbers of the plural winding stations, wherein the respective predetermined numbers of full yarn packages for the plural winding stations are determined by dividing the predetermined total number of full yarn packages by the number of winding stations of the automatic textile yarn winder and, in the event that the quotient is not an integer, rounding off the quotient up or down respectively for each individual winding station to a respective integer within an upper and a lower limit value, each individual winding station's respective rounded-off integer representing the respective predetermined number of full yarn packages to be wound thereat, the sum of all the rounded-off-integers being equal to the predetermined total number of yarn packages, and (b) means associated with said storing means for individually deactuating each winding station and the respective yarn supply after the respective predetermined number of full yarn packages is wound at the individual winding station, said deactuating means comprising means for detecting the number of full yarn packages finished at each winding station, second memory locations for storing the detected number of full yarn packages per winding station, means for comparing the detected number of full yarn packages for each winding station with the command value representing the respective predetermined number for said winding station, and a circuit for deactuating the winding stations once the command value is reached.

8. The automatic winder of claim 7, wherein the second memory locations of said deactuating means have memory channels for storing respective downtimes specific to the respective winding stations, and further comprising a monitoring device associated with the second memory locations and with the storing means and operative in the event of a backlog in the number of yarn packages produced by a winding station because of a failure thereat to reduce by one the command value of the winding station with the backlog and at the same time to increase by one the command value of another predetermined winding station.

9. The automatic winder of claim 7 and further comprising a closed transport system for conveying to and from said winding stations yarn tube carriers on which yarn-wound tubes are supported, the transport system including a distribution path extending along the winding stations, and gate means for closing a portion of the distribution path to the delivery of cops.

10. The automatic winder of claim 9, wherein the transport system includes a main delivery path, branch paths from the main delivery path arranged to transport yarn tube carriers at spacings from the main delivery path to the distribution path, and controllable shunts disposed at the entrances to the branch paths for metered delivery of yarn tube carriers to the distribution path.

11. The automatic winder of claim 10, wherein the transport system includes a detour path from the main delivery path for receiving yarn tube carriers having excess cops that are not introduced into the branch paths and for returning the excess carriers to a tube return path.

* * * * *